US005679308A

United States Patent [19]

Oye et al.

[11] Patent Number: 5,679,308

[45] Date of Patent: Oct. 21, 1997

[54] METHOD OF PRESERVING POROUS MATERIAL

[75] Inventors: Raysabro Oye; Takayuki Okayama; Masaaki Akagi, all of Tokyo, Japan

[73] Assignee: Nippon Filing Co., Ltd., Tokyo, Japan

[21] Appl. No.: 547,168

[22] Filed: Oct. 24, 1995

[51] Int. Cl.[6] ..... D21H 17/56; D21H 19/30; D21H 21/38

[52] U.S. Cl. ..... 422/40; 162/160; 162/183

[58] Field of Search ..... 422/34, 40; 8/196, 8/119, 181, 144.2, 120, 116.1; 427/255.6; 162/158, 160, 182, 183; 252/380, 384, 403

[56] References Cited

U.S. PATENT DOCUMENTS

| | | | |
|---|---|---|---|
| 3,472,611 | 10/1969 | Langwell | 422/40 X |
| 3,703,353 | 11/1972 | Kusterer, Jr. et al. | 162/160 X |
| 4,863,566 | 9/1989 | Warren et al. | 162/160 |

*Primary Examiner*—Robert J. Warden
*Assistant Examiner*—E. Leigh Dawson
*Attorney, Agent, or Firm*—Joseph Scafetta, Jr.

[57] ABSTRACT

A porous material such as paper made of cellulose fiber prepared by a preservation method of the present invention can retain excellent folding endurance after being subjected to accelerated aging treatment performed at a high temperature with high humidity. The method for preserving the porous material includes the steps of placing a porous material made of mainly cellulose fiber in an airtight chamber, evacuating the airtight chamber to reduce the pressure, supplying an ammonia gas into the airtight chamber to thereby neutralize an acidic substance present in the porous material, simultaneously permitting the porous material to absorb the ammonia gas, and supplying an ethylene-oxide-containing gas into the airtight chamber to thereby react with an ammonia present on the surface of and inside the porous material, thus producing an alkaline substance principally consisting of triethanolamine and allowing the alkaline substance to attach to the porous material.

7 Claims, No Drawings

METHOD OF PRESERVING POROUS MATERIAL

BACKGROUND OF THE INVENTION

1. Field of the Invention

The present invention relates to a method of preserving porous materials, such as paper, cardboard and cloth which are made of cellulose fiber such as wood pulp, vegetable fiber or regenerated cellulose fiber.

2. Description of the Related Art

The porous materials mentioned above have been used in information recording, packaging, clothes, arts and other products for thousands of years. Cellulose is a main component of vegetable fibers such as wood pulp, bast fiber and seed fiber. Even though chemically stable, cellulose will be gradually degraded and decomposed while being preserved for many years. In other words, the chemical and physical characteristics of cellulose deteriorate with the passage of time.

To be more specific, while cellulose fiber is preserved for a long period of time or is placed in an atmosphere of a high temperature or a high temperature with high humidity, cellulose loses its physical strength since the degree of polymerization decreases, in other words, depolymerization occurs, and the degree of crystallization increases. Consequently, porous material such as paper, cardboard and cloth made of cellulose fiber decreases in strength.

Particularly, to prepare the paper for books, acidic substances such as alum and aluminium sulfate are usually added. The acidic substance can fix a sizing agent such as rosin or glue, which prevents ink blotting on the cellulosic fibrous materials. Moreover, cellulose is self-decomposed by the influence of oxygen or acidic gases present in the atmosphere, or light, producing acidic groups such as a carbonyl group and further producing acidic substances such as levulinic acid. The porous materials such as paper, cardboard and cloth absorb acidic substances present in the air, such as sulfur dioxide and nitrogen oxide. The acidic substances thus added and absorbed accelerate depolymerization and recrystallization of cellulose fiber. Consequently, the porous materials such as paper, cardboard and cloth made of cellulose fiber decrease in strength.

The U.S. Pate. No. 4,863,566 discloses a process for the treatment of porous materials such as paper and cardboard containing the acidic substances to preserve the porous materials against deterioration through aging. In this process, the acidic substances are neutralized with moist ammonia or the like in a gas phase.

More specifically, the process for the treatment of cellulose material to preserve the cellulose material against deterioration through aging comprises the steps of:

- placing the cellulose material to be treated in an airtight chamber and evacuating the chamber;
- injecting ammonia into the evacuated chamber to penetrate the cellulose material; and
- introducing water vapor into the evacuated chamber, and introducing an alkylene oxide agent into the evacuated chamber, which reacts to produce primary, secondary and tertiary amines in situ.

The U.S. Pat. No. 4,863,566 describes that water is indispensable especially to improve the neutralization activity, so that an aqueous solution of ammonium hydroxide must be used as an ammonia source, and alternatively, water vapor must be introduced after an ammonia gas is supplied. The U.S. Patent teaches that in the absence of humidity, gaseous ammonia will not react with an alkylene oxide gas such as ethylene oxide.

However, the conventional preservation method mentioned above is not completely satisfactory in view of results of the folding endurance test performed after an accelerated aging treatment.

SUMMARY OF THE INVENTION

The object of the present invention is to provide a method of preserving a porous material capable of retaining excellent folding endurance after being subjected to accelerated aging treatment at a high temperature with high humidity.

To be more specific, the present invention provides a method of preserving a porous material, which comprises the steps of:

- placing a porous material made of mainly cellulose fiber in an airtight chamber and evacuating the airtight chamber to reduce the pressure;
- supplying an ammonia gas into the airtight chamber to thereby neutralize an acidic substance present in the porous material placed in the airtight chamber and simultaneously permitting the porous material to absorb the ammonia gas; and
- supplying an ethylene-oxide-containing gas into the airtight chamber to thereby react with an ammonia present on the surface of and inside the porous material, producing an alkaline substance principally consisting of triethanolamine and allowing the alkaline substance to attach to the porous material.

Additional objects and advantages of the invention will be set forth in the description which follows, and in part will be clear from the description, or may be learned by practice of the invention. The objects and advantages of the invention may be realized and obtained by means of the instrumentalities and combinations particularly pointed out.

DETAILED DESCRIPTION OF THE PREFERRED EMBODIMENTS

Hereinbelow, the method of preserving porous material according to the present invention will be described in detail.

(Step 1)

A porous material made of mainly cellulose fiber is placed in an airtight chamber, which is subsequently evacuated to reduce the pressure.

Examples of the porous material include papers such as a high-grade wood free paper, a medium-grade paper, and a high-grade woody paper, cardboard, cloth and the like.

The inner gas such as the air of the airtight chamber is removed to reduce the inner pressure preferably to a range that extends from below 0 to 10 torr.

(Step 2)

An ammonia gas is supplied into the airtight chamber and neutralizes acidic substances present in the porous material placed in the chamber. The supplied ammonia gas is simultaneously absorbed into the porous material. The ammonia gas used herein is a pure ammonia gas, which is supplied, for example, by connecting an ammonia gas cylinder to the airtight chamber.

(Step 3)

Subsequently to the ammonia gas supply, an ethylene-oxide-containing gas is supplied to the airtight chamber. The ethylene-oxide-containing gas thus supplied reacts with an ammonia present on the surface of and inside the porous material. As a result, an alkaline substance principally consisting of triethanolamine is produced and attached onto the porous material, thereby improving the quality-retaining ability of the porous material.

The ethylene-oxide-containing gas may be supplied into the airtight chamber alone or in a state of a gas mixture containing ethylene oxide diluted with an inert gas such as a nitrogen gas or an argon gas.

The alkaline substance consists of monoethanolamine, diethanolamine and triethanolamine. The triethanolamine is contained in the alkaline substance preferably in an amount of 65 wt % or more, more preferably 70 wt % or more, most preferably 80 wt % or more. If the content of triethanolamine is less than 65 wt %, it will be not so effective to improve the quality-retaining ability of the porous material such as paper.

The porous material such as paper made of cellulose fiber and treated by the preservation method according to the present invention can retain excellent folding strength after the porous material is subjected to acute degradation treatment performed at a high temperature with high humidity.

The present inventors have conducted studies and found that ethanolamines are produced when a porous material such as paper containing acidic substances is neutralized in a gas phase consisting of an ammonia gas and ethylene oxide gas, and that triethanolamine having the highest boiling point of the ethanolamines thus produced retains a neutralization activity for a long period of time.

Furthermore, the present inventors have studied behavior for neutralizing the porous material with an ammonia gas and an ethylene oxide gas. As a result, they found that it is not particularly necessary to add water in a reaction system of the ammonium gas and ethylene oxide. They further elucidated the following facts. That is, if water is independently added, for example, in a state of water vapor, ethylene oxide will react with water, producing glycols. Therefore, the agent, i.e., ethylene oxide, is rather wasted. Moreover, there is a decrease in the yield of triethanolamine having a neutralization activity over a long period of time mentioned above.

Then, they tried the method which comprises steps of placing a porous material such as paper in an airtight chamber and reduced the pressure thereof, supplying an excessive amount of ammonia gas, supplying ethylene oxide and allowing ethylene oxide to react with an ammonia present on the surface of and inside the porous material. As a result, amines mainly consisting of triethanolamine were successfully produced and the amines were attached onto the porous material. Thus they achieved the method of preserving a porous material of the present invention. The porous material containing triethanolamine thus treated can retain excellent folding endurance even after the porous material is subjected to acute degradation treatment at a high temperature with high humidity.

According to the preservation method of the present invention, since the porous material is not exposed to a moist atmosphere, the formation of irregularities called cockle on the surface of the porous material is successfully prevented.

Hereinbelow, Examples of the present invention will be described in detail.

EXAMPLE 1

First, medium-grade printing paper of pH 6.8 was placed in an airtight chamber. The air was removed from the chamber by operating a vacuum pump connected to the chamber for one hour and the inner pressure of the chamber was reduced to a predetermined value. After a nitrogen gas was supplied to an atmospheric pressure, the pressure of the chamber was reduced to 10 torr by operating the vacuum pump again. Thereafter, an ammonia gas free from water vapor, i.e., a moistureless ammonia gas, was supplied into the chamber from an ammonia cylinder so as to be contained in a concentration of 0.032 g/l. The chamber was then allowed to stand alone for 4 hours.

Subsequently, a nitrogen-diluted gas mixture containing a 10 vol % ethylene oxide gas was supplied into the airtight chamber so as to be contained in a concentration of 0.328 g/l and allowed to react with an ammonia present on the surface of and inside the paper. The reaction was carried out at a temperature of 30° C. for 12 hours. After completion of the reaction, a nitrogen gas was introduced into the chamber to remove remaining gas therefrom. Thereafter, the medium-grade printing paper was taken out of the chamber.

Comparative Example 1

A medium-grade printing paper was neutralized in a similar manner as in Example 1 except that a moist ammonia gas was used instead of a moistureless ammonia gas. The moist ammonia gas used herein was produced by warming aqueous ammonia.

The amounts of monoethanolamine, diethanolamine and triethanolamine contained in the medium-grade printing paper treated in Example 1 and Comparative Example 1 were measured. PH values and folding endurance were individually measured immediately after the aforementioned treatment and after the papers were subjected to 2-week acute degradation at 80° C. and 80% RH. The results are shown in the following Table 1. On the other hand, the pH values and folding endurance with respect to an untreated medium-grade paper were also measured before and after the 2-week accelerated aging performed at 80° C. and 80% RH. The results are also listed as Reference Example 1 in Table 1.

TABLE 1

| | Example 1 | Comparative Example 1 | Reference Example 1 |
|---|---|---|---|
| Treatment for high-grade woody printing paper | Ammonia + ethylene oxide | Moist ammonia + ethylene oxide | Not treated |
| 1) Content (wt %) of ethanol amine in paper | | | |
| monoethanolamine | Trace | 0.14 | — |
| diethanolamine | 0.07 | 0.05 | — |
| triethanolamine | 0.41 | 0.29 | — |

TABLE 1-continued

| | Example 1 | Comparative Example 1 | Reference Example 1 |
|---|---|---|---|
| 2) PH value | | | |
| Immediately after treatment | 9.9 | 9.0 | 6.8 |
| 2 weeks after acute degradation at 80° C. and 80% RH | 7.6 | 7.6 | 6.6 |
| 3) Folding endurance* (times) | | | |
| Immediately after treatment | 3234 | 2584 | 2653 |
| 2 weeks after acute degradation at 80° C. and 80% RH | 2159 | 704 | 375 |

*The folding endurance is a value obtained when paper folded while being stretched at a tensile strength of 200 gf.

It is apparent from Table 1 that the medium-grade printing paper treated by the method of Example 1 exhibits a higher degree of folding endurance after the acute degradation treatment, in comparison with the paper treated by a conventional method of Comparative Example 1. This is ascribed to the fact that the medium-grade printing paper treated by the method of Example 1 contains triethanolamine, which has the highest boiling point of the aforementioned three ethanolamines and thus retains an excellent neutralizing ability for a long period of time, in a ratio as high as about 85.4 wt %, as shown in Table 1.

Example 2

A printing paper containing mechanical pulp of pH 5.8 as a main component was placed in an airtight chamber in the same manner as in Example 1. After the chamber was reduced to a pressure of 10 torr, an ammonia gas, i.e., a moistureless ammonia gas, was supplied into the chamber from an ammonia cylinder so as to be contained in a concentration of 0.032 g/l. Then, the chamber was allowed to stand alone at 60° C. for 4 hours. Subsequently, a nitrogen-diluted gas mixture containing a 10 vol % ethylene oxide gas was supplied into the airtight chamber so as to be contained in a concentration of 0.246 g/l and allowed to react with an ammonia present on the surface of and inside the paper. The reaction was carried out at a temperature of 60° C. for 12 hours. After completion of the reaction, a nitrogen gas was introduced into the chamber to remove remaining gas therefrom and the high-grade woody printing paper was taken out of the chamber.

Comparative Example 2

A woody printing paper was neutralized in a similar manner as in Example 2 except that a moist ammonia gas was used instead of a moistureless ammonia gas. The moist ammonia gas used herein was produced by warming 9% aqueous ammonia solution.

The amounts of monoethanolamine, diethanolamine and triethanolamine contained in the woody printing paper treated in Example 2 and Comparative Example 2 were measured. PH values and folding endurance were individually measured immediately after the aforementioned treatment and after the papers were subjected to 2-week accelerated aging at 80° C. and 80% RH. The results are shown in the following Table 2. On the other hand, the pH values and folding endurance with respect to an untreated woody printing paper were also measured before and after the 2-week acute degradation treatment performed at 80° C. and 80% RH. The results are also listed as Reference Example 2 in Table 2.

TABLE 2

| | Example 2 | Comparative Example 2 | Reference Example 2 |
|---|---|---|---|
| Treatment for woody printing paper | Ammonia + ethylene oxide | Moist ammonia + ethylene oxide | Not treated |
| 1) Content (wt %) of ethanol amine in paper | | | |
| monoethanolamine | Trace | 0.19 | |
| diethanolamine | 0.09 | 0.09 | |
| triethanolamine | 0.40 | 0.21 | |
| 2) PH value | | | |
| Immediately after treatment | 8.6 | 8.3 | 5.9 |
| 2 weeks after acute degradation at 80° C. and 80% RH | 7.1 | 6.5 | 5.6 |
| 3) Folding endurance* (times) | | | |
| Immediately after treatment | 2107 | 2550 | 2107 |
| 2 weeks after acute degradation at 80° C. and 80% RH | 1061 | 678 | 311 |

*The folding endurance is a value obtained when paper is folded while being stretched at a tensile strength of 200 gf.

It is apparent from Table 2 that the woody printing paper treated by the method of Example 2 exhibits a high degree of folding endurance after the acute degradation treatment, in comparison with the paper treated by a conventional method of Comparative Example 2. This is ascribed to the fact that the woody printing paper treated by the method of Example 2 contains triethanolamine, which has the highest boiling point of all ethanolamines and thus retains an excellent neutralizing ability for a long period of time, in a ratio as high as about 81.6 wt %, as shown in Table 2.

It should be noted that if a propylene oxide gas is used instead of the ethylene oxide gas in the method of preserving a porous material according to the present invention, it is possible to attain the same effects as those obtained in the Examples.

As described in the foregoing, the porous material made of cellulose fiber prepared by the preservation method of the present invention can retain excellent folding endurance even after it is subjected to the accelerated aging treatment performed at a high temperature with high humidity. Moreover, the formation of irregularities called cockle on the surface of the porous material such as paper made of cellulose fiber can be prevented. As a result, the method of the present invention is successfully applied to prevent deterioration of a wide variety of books stored in libraries and archives.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A method of preserving porous material, comprising the steps of:

placing a porous material made of a substance, selected from a group consisting of paper, cardboard, and cloth, in an airtight chamber and evacuating said airtight chamber to reduce pressure of said airtight chamber;

supplying an ammonia gas into said airtight chamber to thereby neutralize an acidic substance present in said porous material placed in said airtight chamber and simultaneously permitting said porous material to absorb said ammonia gas; and supplying an ethylene-oxide-containing gas into said airtight chamber to thereby react with an ammonia present on the surface of and inside said porous material, producing an alkaline substance and allowing the alkaline substance to attach to said porous material;

wherein said alkaline substance consists of monoethanolamine, diethanolamine, and triethanolamine; and wherein said triethanolamine is present in an amount of 65 wt % or more of the alkaline substance.

2. A method according to claim 1, wherein said porous material is paper.

3. A method according to claim 1, wherein the pressure of said chamber is reduced to a range that extends from below 0 to 10 torr.

4. A method according to claim 1, wherein said ethylene-oxide-containing gas is an ethylene oxide gas.

5. A method according to claim 1, wherein said ethylene-oxide-containing gas is a nitrogen-diluted ethylene oxide gas.

6. A method according to claim 1, wherein said triethanolamine is present in an amount of 70 wt % or more.

7. A method according to claim 1, wherein said triethanolamine is present in an amount of 80 wt % or more.

* * * * *

UNITED STATES PATENT AND TRADEMARK OFFICE

CERTIFICATE OF CORRECTION

PATENT NO. : 5,679,308
DATED : October 21, 1997
INVENTOR(S) : Raysabro Oye et al.

It is certified that error appears in the above-indentified patent and that said Letters Patent is hereby corrected as shown below:

Col. 1, line 45, "Pate." should be --Pat.--.

Col. 3, line 42, change "chamber and reduced" to --chamber, reducing--; and line 48, after "Thus", insert a comma.

Col. 4, line 6, "Examples" should be --examples--.

Col. 5, line 15, after "paper", insert --is--.

Signed and Sealed this

Thirtieth Day of June, 1998

*Attest:*

*Attesting Officer*

Bruce Lehman

BRUCE LEHMAN

*Commissioner of Patents and Trademarks*